US006715224B1

(12) United States Patent
Lin

(10) Patent No.: US 6,715,224 B1
(45) Date of Patent: Apr. 6, 2004

(54) DISPLAYING ORNAMENT WITH ROTATIONAL COLOR DISC

(76) Inventor: Ming-Kuei Lin, 17F, No. 309, Sec. 2, Wen Hua Road, Panchiao, Taipei Hsien (TW)

( * ) Notice: Subject to any disclaimer, the term of this patent is extended or adjusted under 35 U.S.C. 154(b) by 0 days.

(21) Appl. No.: 10/263,075

(22) Filed: Oct. 3, 2002

(51) Int. Cl.[7] ..... G09F 13/24
(52) U.S. Cl. ..... 40/410; 40/409
(58) Field of Search ..... 40/410, 409, 433, 40/435

(56) References Cited

U.S. PATENT DOCUMENTS 3,964,194 A 6/1976 Gugeler ..... 40/106.21
5,706,594 A 1/1998 Lin ..... 40/406
6,263,600 B1 * 7/2001 Brink ..... 40/410
2002/0112382 A1 * 8/2002 Butcher ..... 40/406

* cited by examiner

*Primary Examiner*—Cassandra Davis
(74) *Attorney, Agent, or Firm*—Troxell Law Office PLLC

(57) ABSTRACT

A displaying ornament with rotatable color disc includes a base and a color disc circumferentially rotatably mounted on the base. The color disc includes a plurality of parallelly arranged clear thin plates to provide a closed narrow space between any two adjacent thin plates. Each of the narrow spaces has a differently colored liquid and a small amount of air contained therein, and has a plurality of circumferentially equally spaced air-collecting units formed along an outer peripheral area thereof to catch air bubbles moving upward in the narrow spaces. When the color disc is rotated, air bubbles caught in the air-collecting units are moved from an upper position to a lower position in the color disc and automatically released from the air-collecting units to float and overlap each other in the narrow spaces to show non-uniform shapes, continuously creating dynamic and colorful views in the displaying ornament.

3 Claims, 4 Drawing Sheets

DISPLAYING ORNAMENT WITH ROTATIONAL COLOR DISC

BACKGROUND OF THE INVENTION

The present invention relates to a displaying ornament with rotational color disc, and more particularly to a displaying ornament having a circumferentially rotatable color disc, in which air bubbles continuously move upward and overlap each other in differently colored liquids contained in a plurality of parallelly arranged closed narrow spaces, and thereby cyclically create many non-uniform colored shapes in the displaying ornament.

There are various commercially available ornaments being filled with differently colored liquids to show changeful and colorful views. U.S. Pat. No. 3,964,194 entitled "Changeable Color Display Device" and U.S. Pat. No. 5,706,594 entitled "Rotational Color-liquid Decoration", which is invented by the same inventor of the present invention, all disclose these types of ornaments.

The Changeable Color Display Device disclosed in the U.S. Pat. No. 3,964,194 includes a pump to continuously produce air bubbles at bottoms of multiple color-liquid containers, so that the produced air bubbles float and be released via air outlets provided at a top of the containers. When the air bubbles float through the colored liquids, they create changes in colors in the liquid containers. A problem with the device of U.S. Pat. No. 3,964,194 is that the colored liquids leak via the top air outlets when the device is tilted over, causing difficulties in shipping and using of the device.

The Rotational Color-liquid Decoration disclosed in U.S. Pat. No. 5,706,594 includes a rotational wheel having two containers, each of which has two different liquids contained therein. One of the two liquids having a higher specific gravity drips down through the other liquid having a lower specific gravity to create changes in colors in the containers. No air bubble is utilized in the U.S. Pat. No. 5,706,594.

SUMMARY OF THE INVENTION

A primary object of the present invention is to provide a displaying ornament with rotational color disc, which employs the structure of the Rotational Color-liquid Decoration disclosed in the U.S. Pat. No. 5,706,594 that is also invented by the inventor of the present invention, and directly includes an amount of air in the color disc without using a pump to produce air bubbles, so that the displaying ornament includes air bubbles continuously moving upward in the color disc while overcomes the problem of leaking colored liquid in the U.S. Pat. No. 3,964,194.

To achieve the above and other objects, the displaying ornament with rotational color disc of the present invention mainly includes a base and a color disc circumferentially rotatably mounted on the base. The color disc includes a plurality of parallelly arranged clear thin plates to provide a closed narrow space between any two adjacent thin plates. Each of the narrow spaces has a differently colored liquid and a small amount of air contained therein, and is divided into a central and an outer peripheral area. The outer peripheral area has a plurality of circumferentially equally spaced baffles mounted therein to form a plurality of air-collecting units for catching air bubbles moving upward through the central area in the narrow space. When the color disc is rotated and air bubbles caught in the air-collecting units are moved from a higher position to a lower position in the color disc, the air bubbles are automatically released from the air-collecting units to float and overlap each other in the central area of the narrow spaces to show many non-uniform shapes, continuously creating dynamic and colorful views in the displaying ornament.

The air bubbles are repeatedly collected in and released from the air-collecting units while the color disc rotates, enabling the displaying ornament of the present invention to cyclically show the changeful and colorful views in the color disc.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
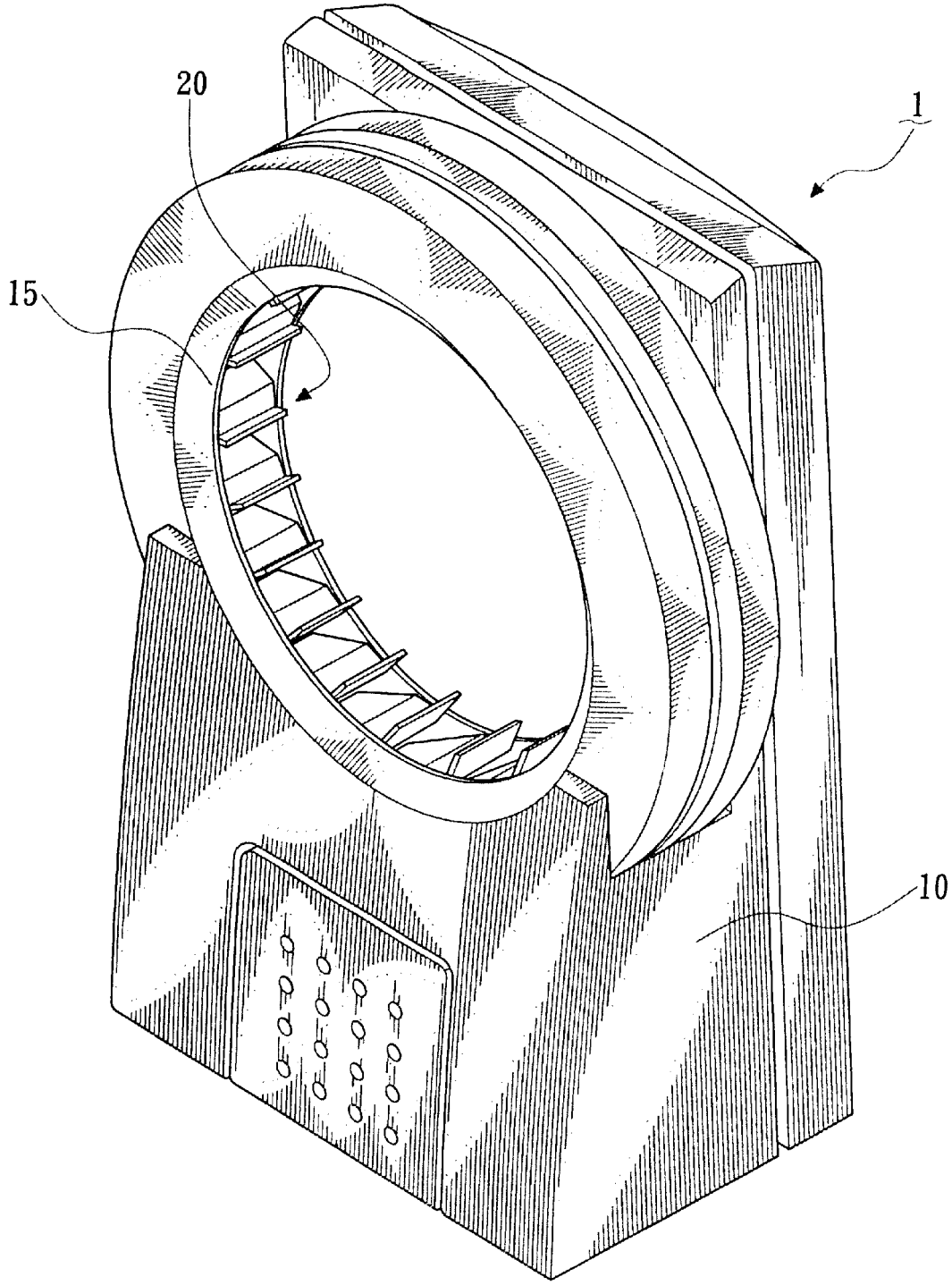
FIG. 1 is a perspective view of a displaying ornament with rotational color discs according to an embodiment of the present invention.
Figure 2:
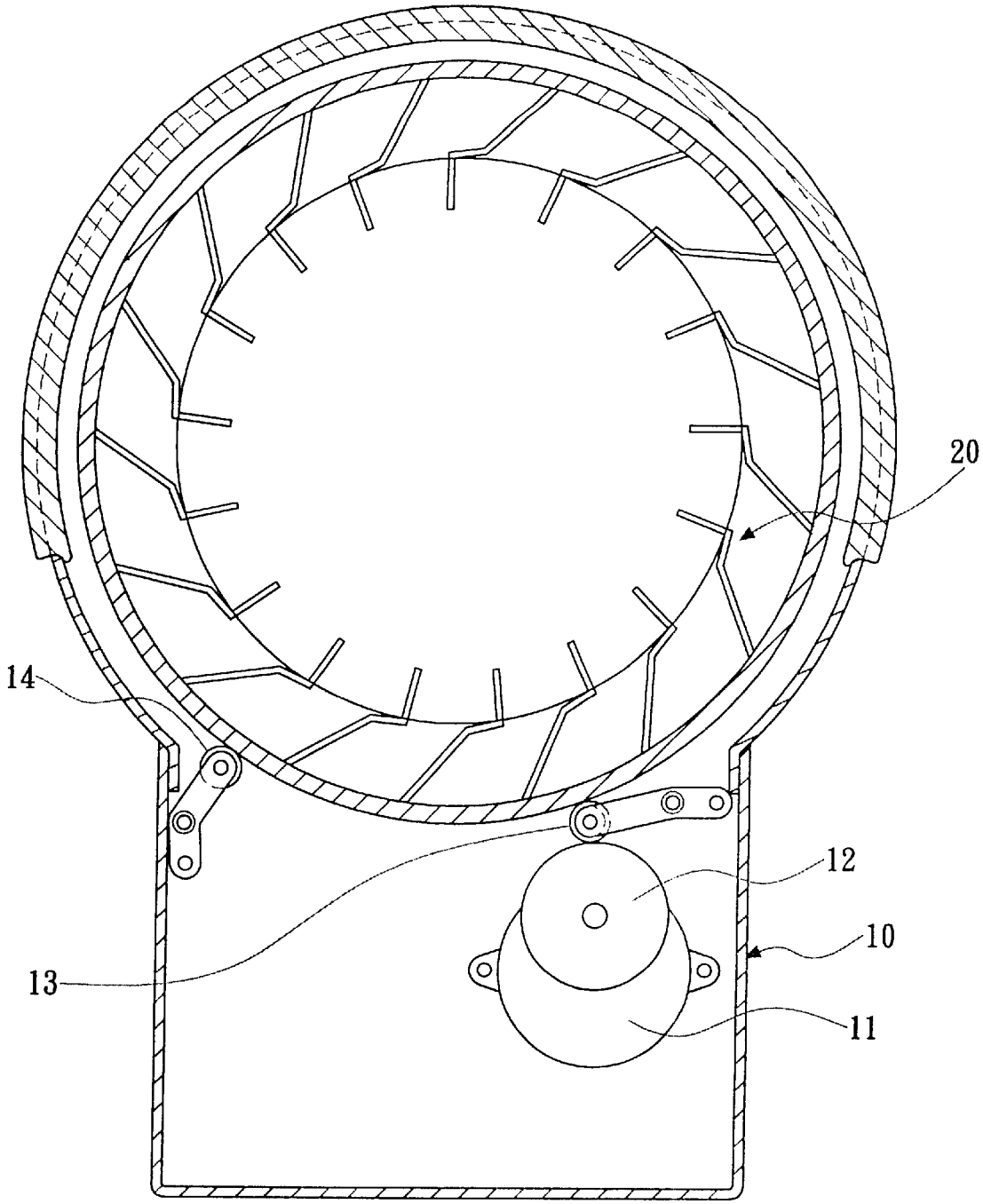
FIG. 2 is a sectioned front view of the displaying ornament of FIG. 1.
Figure 3:
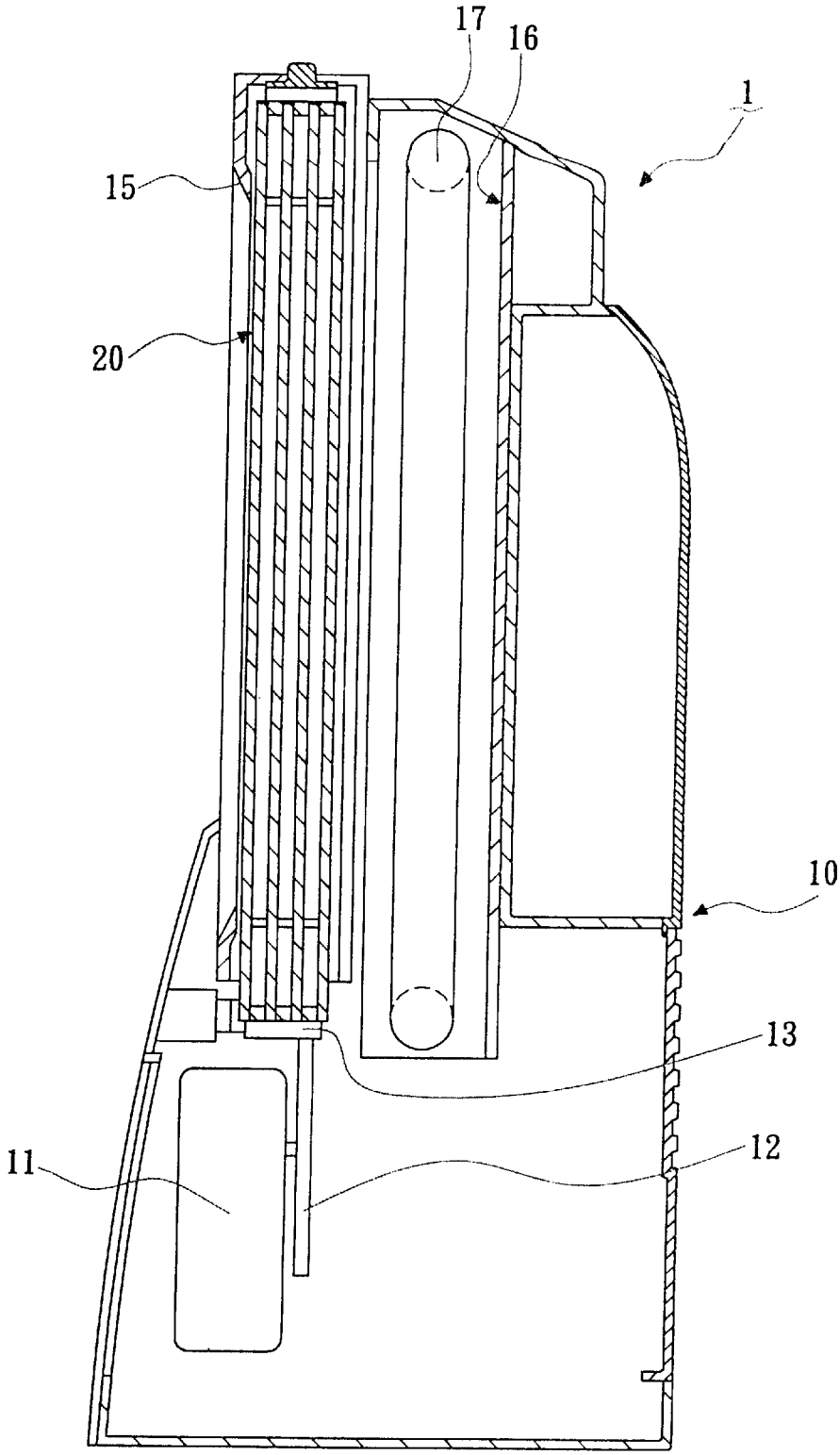
FIG. 3 is a sectioned side view of the displaying ornament of FIG. 1.

Please refer to FIGS. 1, 2 and 3 that are perspective, sectioned front, and sectioned side views, respectively, of a displaying ornament with rotational color disc according to an embodiment of the present invention. As shown, the displaying ornament 1 mainly includes a base 10 and a color disc 20 mounted on the base 10.

As can be seen in FIG. 2, the base 10 is internally provided with a motor 11 for rotating a driving wheel 12. When the driving wheel 12 is rotated, it brings a driven wheel 13 supported below the color disc 20 to rotate at the same time. The rotated driven wheel 13 is adapted to drive the color disc 20 to rotate in a circumferential direction. An idle wheel 14 is mounted in the base 10 below the color disc 20 opposite to the driven wheel 13, so as to together with the driven wheel 13 supports the color disc 20 in a circumferentially stably rotatable position. An upper front area of the base 10 is formed into a round window 15, via which a central area 23 of the color disc 20 (see also FIGS. 4 and 4A) is exposed. As can be seen in FIG. 3, a background plate 16 is provided in the base 10 behind the color disc 20. An annular lighting tube 17 is fixed in the base 10 between the color disc 20 and the background plate 16 to illuminate the latter, allowing the color disc 20 to be clearly viewed against the illuminated background plate 16.

Figure 4A:
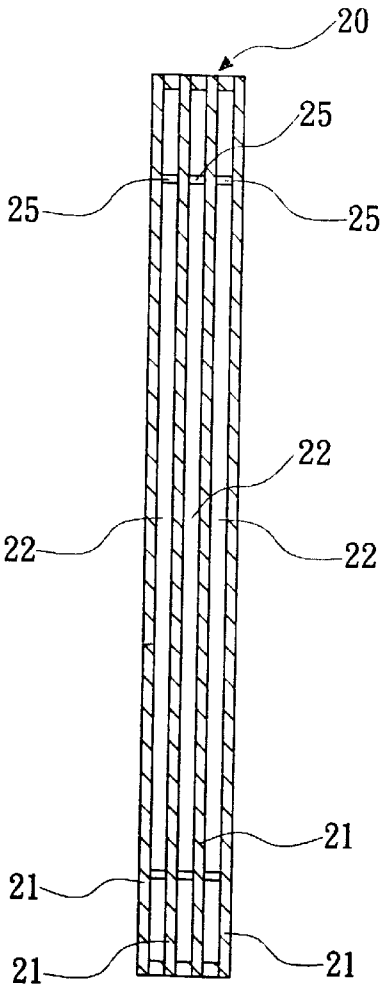
FIG. 4A is a sectioned side view of FIG. 4.
Figure 4:
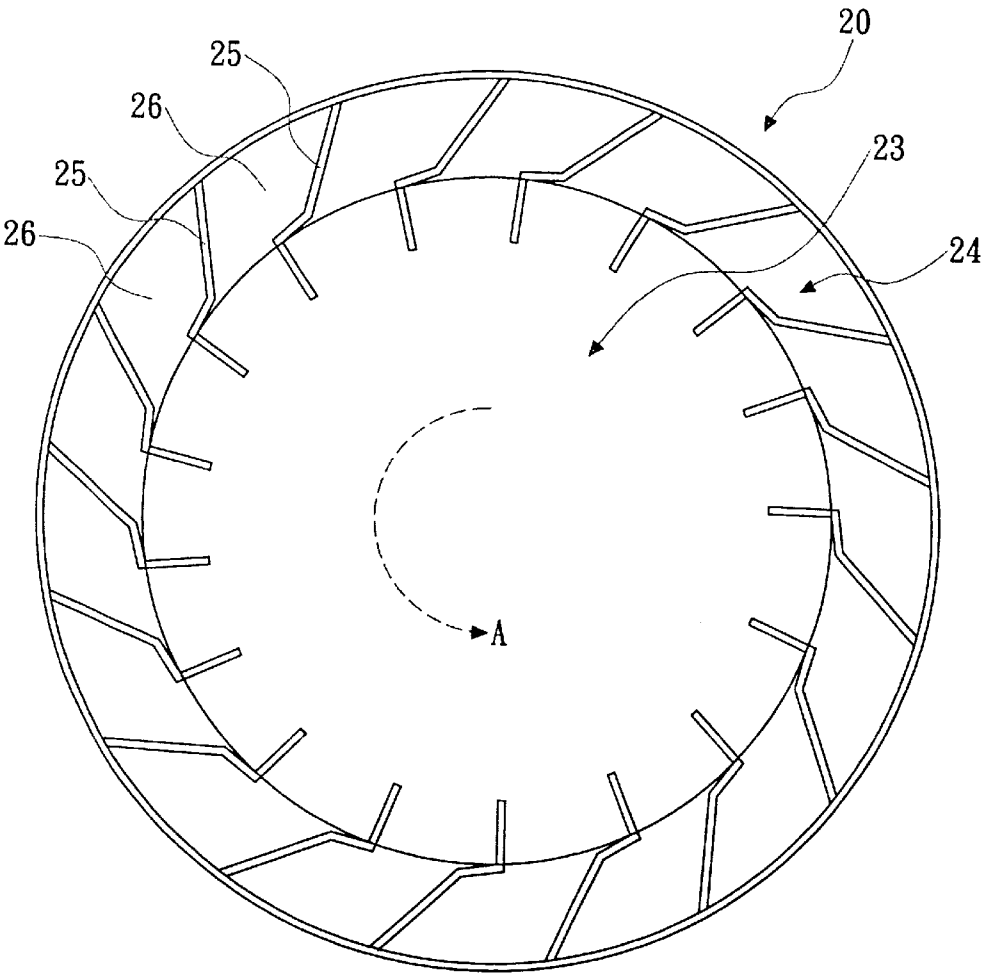
FIG. 4 is a sectioned front view of the color disc included in the displaying ornament of the present invention.

Please refer to FIGS. 4 and 4A that are sectioned front and sectioned side views, respectively, of the color disc 20. As shown, the color disc 20 includes a plurality of parallelly spaced transparent thin plates 21. In the illustrated embodiment of the present invention, there are four transparent thin plates 21 included in the color disc 20 to create three closed narrow spaces 22. Each of the narrow spaces 22 has a suitably small width for containing a certain colored liquid and a small amount of air. Each narrow space 22 is further divided into a central area 23 and an outer peripheral area 24 surrounding the central area 23. A plurality of baffles 25 are equally spaced along the outer peripheral area 24 in a circumferential direction to further divide the outer peripheral area 24 into a plurality of air-collecting units 26. The baffles 25 are so arranged that their radially inner ends forward extend in the rotating direction of the color disc 20, as indicated by the arrow A, to form a circumferentially inclined position. This design allows air bubbles existing in the colored liquid contained in each narrow space 22 to be caught in the air-collecting units 26 of the rotating color disc 20 until the air-collecting units 26 are moved from an upper position to a lower position in the color disc 20. Air bubbles caught in the air-collecting units 26 that have been moved close to the lower position in the color disc 20 are automatically released to move upward along the baffles 25 into and through the central area 23.

When the color disc 20 is rotating, air bubbles in the colored liquids contained in the narrow spaces 22, due to their light weight, gradually float and are caught in the air-collecting units 26 in the outer peripheral area 24 that are now located at an upper position in the color disc 20. The air bubbles caught in tile air-collecting units 26 are then brought to a lower position when the color disc 20 rotates and released as mentioned above. That is, the air bubbles are repeatedly collected in and released from the air-collecting units 26 in the color disc 20.

The air bubbles released from the air-collecting units 26 immediately move upward in the colored liquids in the narrow spaces 22. Due to the small width of the narrow spaces 22, the air bubbles continuously change their shapes while they move upward through the narrow spaces 22. When viewing the color disc 20 from the window 15 of the base 10, the air bubbles of non-uniform and changeful shapes in different narrow spaces 22 overlap each other and can be clearly seen against the illuminated background plate 16, creating an excellent displaying and ornamental effect.

What is claimed is:

1. A displaying ornament with a rotational color disc comprising:

a) a base having:

i) a round window located on a front of the base;

ii) a background plate located behind the round window;

iii) a motor with a driving wheel mounted in the base;

iv) a driven wheel rotated by the driving wheel; and v) an idle wheel; and b) a color disc located in the base between the round window and the background plate, aligned with the round window, supported by the driven wheel and the idle wheel, and rotated in a predetermined direction by the driving wheel, the color disc having:

i) at least four transparent, parallel, spaced apart thin plates;

ii) three closed narrow spaces defined by the at least four transparent thin plates and an outer circumference of the color disc, each of the three narrow spaces having a central area and an outer peripheral area surrounding the central area, each of the three narrow spaces being filled with a colored liquid and air;

iii) a plurality of baffles, each extending inwardly from the outer circumference of the color disc within the outer peripheral area of one of the three closed narrow spaces and being equally spaced apart; and iv) a plurality of air-collecting units formed by the plurality of baffles, such that air flows into each of the plurality of air-collecting units when located in a top position by rotation of the color disc and air flows out of each of the plurality of air-collecting units when located in a bottom position by rotation of the color disc.

2. The displaying ornament according to claim 1, further comprising an annular lighting tube located between the background plate and the color disc.

3. The displaying ornament according to claim 1, wherein each of the plurality of baffles is angled in the predetermined direction of rotation of the color disc.

* * * * *